US011401128B2

(12) United States Patent
Nakagaki

(10) Patent No.: US 11,401,128 B2
(45) Date of Patent: Aug. 2, 2022

(54) CONVEYOR AND PRINTER

(71) Applicant: Toshihiro Nakagaki, Ibaraki (JP)

(72) Inventor: Toshihiro Nakagaki, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/078,687

(22) Filed: Oct. 23, 2020

(65) Prior Publication Data

US 2021/0163250 A1 Jun. 3, 2021

(30) Foreign Application Priority Data

Nov. 29, 2019 (JP) ..... JP2019-216216
Oct. 14, 2020 (JP) ..... JP2020-173616

(51) Int. Cl.

| | |
|---|---|
| ***B65H 29/62*** | (2006.01) |
| ***B65H 29/60*** | (2006.01) |
| ***B65H 43/04*** | (2006.01) |
| ***B65H 7/06*** | (2006.01) |
| ***B65H 29/12*** | (2006.01) |

(Continued)

(52) U.S. Cl.

CPC ..... *B65H 29/60* (2013.01); *B41J 13/226* (2013.01); *B65H 5/226* (2013.01); *B65H 29/125* (2013.01); *B65H 43/04* (2013.01)

(58) Field of Classification Search

CPC ..... B65H 29/62; B65H 29/60; B65H 29/125; B65H 43/04; B65H 5/22; B65H 5/222; B65H 5/226; B65H 5/12; B65H 2511/515; B65H 2511/52; B65H 2511/528;

(Continued)

(56) References Cited

U.S. PATENT DOCUMENTS 9,618,896 B2 4/2017 Tanaka
2005/0231578 A1* 10/2005 Tajima ..... B41J 11/009 347/104

(Continued)

FOREIGN PATENT DOCUMENTS

JP 2016-218423 12/2016
JP 2017-019172 1/2017

(Continued)

OTHER PUBLICATIONS

Extended European Search Report dated May 7, 2021.

*Primary Examiner* — Luis A Gonzalez
(74) *Attorney, Agent, or Firm* — Harness, Dickey & Pierce, P.L.C.

(57) ABSTRACT

A conveyor includes a first conveyance path along which a sheet is conveyed in a first direction, a second conveyance path along which the sheet is conveyed in a second direction different from the first direction, a switching part configured to switch a conveyance direction of the sheet between the first direction and the second direction, a sheet detector configured to detect the sheet at the switching part, a conveyance system driver configured to convey and stop the sheet, and circuitry configured to control the conveyance system driver to stop conveyance of the sheet in a predetermined condition, control the sheet detector to detect the sheet at the switching part, and control the switching part to switch the conveyance direction of the sheet from the first direction to the second direction when the sheet detector does not detect the sheet at the switching part.

18 Claims, 12 Drawing Sheets

(51) Int. Cl.
*B65H 5/22* (2006.01)
*B41J 13/22* (2006.01)

(58) Field of Classification Search
CPC ..... B65H 2511/522; B65H 7/06; B65H 7/04; B41J 13/226; B41J 13/22; B41J 13/223
See application file for complete search history.

(56) References Cited

U.S. PATENT DOCUMENTS

2010/0187746 A1* 7/2010 Hirata ..... B65H 7/12 271/3.16
2012/0074638 A1 3/2012 Nakagaki
2013/0027492 A1* 1/2013 Yoneyama ..... B41J 13/226 347/104
2013/0083367 A1* 4/2013 Hara ..... B65H 29/60 358/449
2013/0241146 A1 9/2013 Takai et al.
2013/0307893 A1* 11/2013 Suda ..... B41J 11/04 347/16
2013/0320616 A1 12/2013 Nakagaki
2014/0327207 A1 11/2014 Nakagaki
2016/0114993 A1 4/2016 Nakagaki
2016/0152431 A1 6/2016 Maeda et al.
2016/0318731 A1 11/2016 Kowase et al.
2016/0334750 A1 11/2016 Nakagaki
2017/0072722 A1* 3/2017 Mueller ..... B41J 25/304
2017/0210581 A1* 7/2017 Van Acquoij ..... B41J 11/0095
2017/0239967 A1* 8/2017 Suzuki ..... B41J 11/42

FOREIGN PATENT DOCUMENTS

JP 2017-124890 7/2017
WO WO2014/136631 A1 9/2014

* cited by examiner

CONVEYOR AND PRINTER

CROSS-REFERENCE TO RELATED APPLICATIONS

This patent application is based on and claims priority pursuant to 35 U.S.C. § 119(a) to Japanese Patent Application No. 2019-216216, filed on Nov. 29, 2019, in the Japan Patent Office and Japanese Patent Application No. 2020-173616, filed on Oct. 14, 2020, in the Japan Patent Office, the entire disclosures of which are hereby incorporated by reference herein.

BACKGROUND

Technical Field

Aspects of the present disclosure relate to a conveyor and a printer.

Related Art

A conveyance failure may be occurred in a conveyor to convey a sheet when a floating, wrinkles, or breaks or the like of the sheet is occurred on the sheet. Therefore, the conveyor stops the conveyance of the sheet and ejects a subsequent sheet to a predetermined purge tray when the conveyance failure such as the floating, the wrinkles, or the breaks of the sheet occurs. Hereinafter, the floating, wrinkles, or breaks of the sheet is simply referred to as "conveyance failure."

The conveyor includes a first conveyor, a second conveyor, and switch. The first conveyor conveys a medium from a medium supply position toward an image forming area. The second conveyor conveys the medium through a path that does not pass through the image forming area. The switch is provided on an upstream side of the image forming area in a medium conveyance direction of the first conveyor. The switch guides the medium to the second conveyor when the medium is determined that the sheet may cause conveyance failure, and the switch guides the medium to the first conveyor when the medium is determined as normally conveyable.

SUMMARY

In an aspect of this disclosure, A conveyor includes a first conveyance path along which a sheet is conveyed in a first direction, a second conveyance path along which the sheet is conveyed in a second direction different from the first direction, a switching part configured to switch a conveyance direction of the sheet between the first direction and the second direction, a sheet detector configured to detect the sheet at the switching part, a conveyance system driver configured to convey and stop the sheet, and circuitry configured to control the conveyance system driver to stop conveyance of the sheet in a predetermined condition, control the sheet detector to detect the sheet at the switching part, and control the switching part to switch the conveyance direction of the sheet from the first direction to the second direction when the sheet detector does not detect the sheet at the switching part.

In another aspect of this disclosure, a conveyor includes a first conveyance path along which a sheet is conveyed in a first direction, a second conveyance path along which the sheet is conveyed in a second direction different from the first direction, a switching part configured to switch a conveyance direction of the sheet between the first direction and the second direction, a sheet detector configured to detect the sheet at the switching part, a conveyance system driver configured to convey and stop the sheet, a conveyance failure detector configured to detect a conveyance failure, and circuitry configured to: control the conveyance system driver to stop conveyance of the sheet when the conveyance failure detector detects the conveyance failure, control the sheet detector to detect the sheet at the switching part, and control the switching part to switch the conveyance direction of the sheet from the first direction to the second direction when the sheet detector does not detect the sheet at the switching part.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
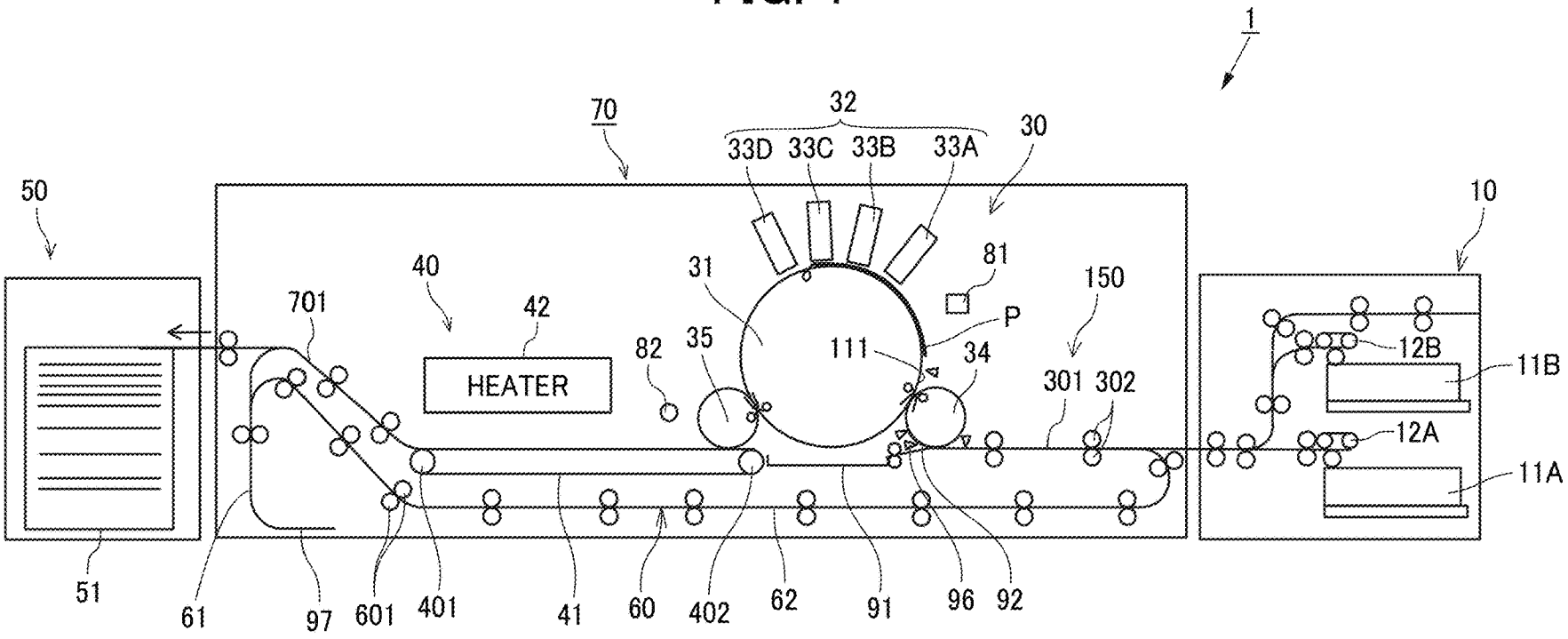
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
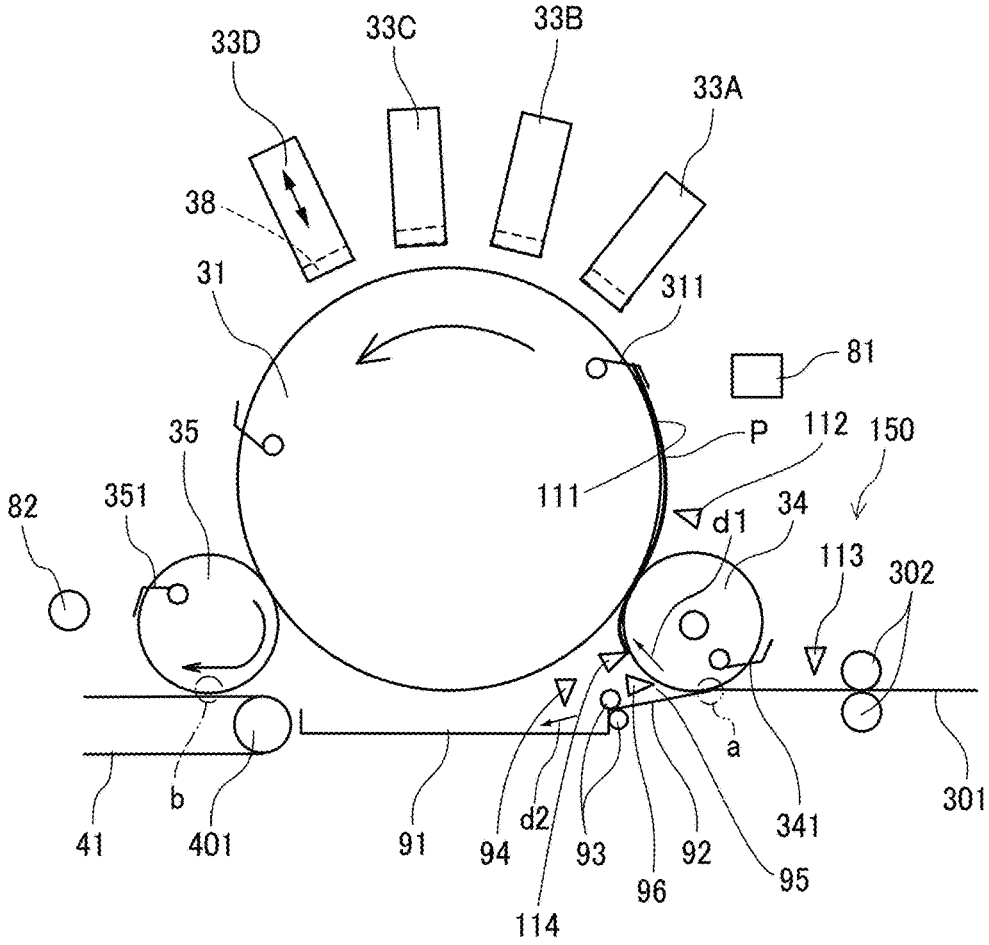
FIG. 2 is an enlarged cross-sectional front view of a portion of the printer around a drum.

Referring now to the drawings, wherein like reference numerals designate identical or corresponding parts throughout the several views, embodiments of the present disclosure are described below. First, a printer according to a first embodiment of the present disclosure is described with reference to FIGS. 1 and 2. FIG. 1 is a schematic cross-sectional front view of the printer according to the first embodiment of the present disclosure. FIG. 2 is an enlarged front view of a portion of the printer 1 around a drum 31.

A printer 1 according to the first embodiment includes a loader 10 to load a sheet P to the printer 1, a printing unit 70, and an ejector 50. The printing unit 70 is a printing device in a narrow sense. The printing unit 70 including a conveyor 150 according to the first embodiment. The printing unit 70 includes an image forming unit 30, a dryer 40, and a duplex mechanism 60. The image forming unit conveys the sheet P and prints on the sheet P. The dryer 40 dries the sheet P on which an image is formed.

The conveyor 150 includes a loading path 301, a drum 31, a conveyance belt 41, a conveyance-roller pair group 803, the duplex mechanism 60, and other components to convey the sheet P in the printing unit 70. The printer 1 may include a preprocessing part between the loader 10 and the printing unit 70. The preprocessing part applies a coating liquid such as pretreatment liquid onto the sheet P.

In the printer 1, the image forming unit 30 of the printing unit 70 applies a liquid onto the sheet P fed (supplied) from the loader 10 to perform required printing (form an image) on the sheet P. Then, the dryer 40 dries the liquid adhered to the sheet P, and the printing unit ejects the sheet P to the ejector 50.

The loader 10 includes loading trays 11 and a feeder 12 to feed (supply) the sheet P to the image forming unit 30. The loading trays 11 includes a lower loading tray 11A and an upper loading tray 11B to accommodate a plurality of sheets P. The feeder 12 includes a first feeder 12A and a second feeder 12B to separate and feed the sheets P one by one from the loading trays 11.

The image forming unit 30 includes the drum 31 and a liquid discharge unit 32. The drum 31 is a bearing rotor (rotating member) that bears the sheet P on a circumferential surface of the drum 31 and rotates. The liquid discharge unit 32 discharges a liquid toward the sheet P borne on the drum 31.

The image forming unit 30 further includes an inlet rotor 34 and an outlet rotor 35. The inlet rotor 34 receives the sheet P fed from an upstream side (loader 10) and transfers the sheet P to the drum 31. The outlet rotor 35 receives the sheet P conveyed from the drum 31 and transfers the sheet P to the dryer 40.

The inlet rotor 34 receives the sheet by gripping a leading end of the sheet P with a sheet gripper 341 at a receipt position "a" as illustrated in FIG. 2. The inlet rotor 34 includes the sheet gripper 341 as a gripper at an outer circumference of the inlet rotor 34. The sheet P received by the inlet rotor 34 is conveyed along an upstream side conveyance path (loading path 301) by a conveyance roller pair 302. Hereinafter, the upstream side conveyance path (loading path 301) is also referred to as a "loading path."

The inlet rotor 34 conveys the sheet P with a rotation of the inlet rotor 34. The conveyed sheet P is delivered to the drum 31 at a facing position opposite (facing) the drum 31.

When the sheet P is conveyed through the loading path 301, the printing unit 70 adjusts a conveyance speed of the sheet P by a conveyance roller pair 302 to adjust timing at which the leading end of the sheet P reaches the sheet gripper 341 of the inlet rotor 34. Further, the printing unit 70 conveys the sheet P to the receipt position "a" while adjusting a skew detector and a corrector to correct an inclination and a conveyance position of the sheet P in a direction perpendicular to a conveyance direction of the sheet P.

Further, the printing unit 70 includes a width detector to detect a width of the sheet P and a length detector to detect a length of the sheet P in the loading path 301. Thus, the printing unit 70 stops a printing operation to prevent the liquid discharge unit 32 from discharging a liquid onto the drum 31 when a measured value of a size of the sheet P is different from a size of the sheet P previously set.

Similarly, the drum 31 includes a sheet gripper 311 on a surface of the drum 31, and the leading end of the sheet P is gripped by the sheet gripper 311 of the drum 31. The drum 31 includes a plurality of suction holes dispersed on a surface of the drum 31, and a suction unit generates suction airflows directed to an interior of the drum 31 from a desired the suction holes of the drum 31.

Then, the leading end of the sheet P delivered from the inlet rotor 34 to the drum 31 is gripped by the sheet gripper 311 of the drum 31, attracted by the suction airflow onto a circumferential surface of the drum 31 by the suction unit, and conveyed to the outlet rotor 35 as the drum 31 rotates.

The liquid discharge unit 32 includes discharge units 33 (discharge units 33A to 33D) to discharge liquids. The discharge unit 33 includes a liquid discharge head as a liquid discharger. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit may discharge a special liquid, that is, a liquid of spot color such as white, gold, or silver.

As illustrated in FIG. 2, the image forming unit 30 includes a cap 38 that caps a discharge surface (nozzle surface) of each discharge unit 33 of the liquid discharge unit 32. The discharge unit 33 is advanceably retractable in a direction indicated by arrow in FIG. 2. The cap 38 is movable in an axial direction of the drum 31. When the cap 38 caps the discharge surface of the discharge unit 33, the discharge unit 33 moves in a direction away from the circumferential surface of the drum 31, and the cap 38 enters below the discharge unit 33 (position between the discharge unit 33 and the drum 31) to cap the discharge surface of the discharge unit 33.

The printing unit 70 controls a discharge operation of each discharge unit 33 of the liquid discharge unit 32 by a drive signal corresponding to print data. When the sheet P borne on the drum 31 passes through the facing position facing the liquid discharge unit 32, the liquids of respective colors are discharged from the discharge units 33 toward the sheet P, and an image corresponding to the print data is formed on the sheet P.

The sheet P on which the image is formed is conveyed from the drum 31 to the outlet rotor 35. The outlet rotor 35 includes a sheet gripper 351 on a circumferential surface of the outlet rotor 35. The sheet gripper 351 receives the sheet P fed from the drum 31. Then, the sheet P is conveyed to the dryer 40 at a delivery position "b" illustrated in FIG. 2 as the outlet rotor 35 rotates.

The dryer 40 includes the conveyance belt 41 and a heater 42. The conveyance belt 41 conveys the sheet P delivered from the outlet rotor 35. The heater 42 heats the sheet P conveyed by the conveyance belt 41. The conveyance belt 41 is an endless belt and is stretched between a drive roller 401 and a driven roller 402.

The dryer 40 dries the liquid adhered onto the sheet P by the image forming unit 30. Thus, a liquid component such as moisture in the liquid evaporates, and the colorant contained in the liquid is fixed on the sheet P. Additionally, curling of the sheet P is restrained. The sheet P that has passed through the dryer 40 is conveyed to the ejector 50 through an ejection path 701 or is sent to the duplex mechanism 60.

The duplex mechanism 60 includes a reverse path 61 and a duplex path 62. The reverse path 61 reverses the sheet P that has passed through the dryer 40 when the printer 1 performs a duplex printing. The duplex path 62 feeds back the sheet P reversed in the reverse path 61 again to the loading path 301. The duplex mechanism 60 includes a plurality of conveyance roller pairs 601 in the reverse path 61 and the duplex path 62. The reverse path 61 reverses a front surface and a back surface of the sheet P.

The ejector 50 includes an ejection tray 51 on which a plurality of sheets P is stacked. The plurality of sheets P conveyed from the dryer 40 is sequentially stacked and held on the ejection tray 51.

The printing unit 70 according to the first embodiment includes the liquid discharge unit 32 to discharge a liquid. However, the printing unit 70 may print by an electrophotographic method.

Next, a configuration of a first conveyance path 111 according to the first embodiment of the present disclosure is described below with reference to FIGS. 1 and 2.

Circumferential surfaces of the inlet rotor 34, the drum 31, and the outlet rotor 35 form the first conveyance path 111 according to the first embodiment of the present disclosure. The sheet P is conveyed along the first conveyance path 111 in a first direction d1 (see FIG. 2).

The drum 31 includes a conveyance drive source. The inlet rotor 34 and the outlet rotor 35 are connected by gears. The conveyance drive source of the drum 31 drives the drum 31, the inlet rotor 34, and the outlet rotor 35 to convey the sheet P along the first conveyance path 111. However, the inlet rotor 34, the drum 31, and the outlet rotor 35 may respectively include drive sources so that the drive sources of the inlet rotor 34, the drum 31, and the outlet rotor 35 individually drive the inlet rotor 34, the drum 31, and the outlet rotor 35.

Operation of an inching switch 81 as a first operator can individually drive a drive source of the first conveyance path 111. Thus, a manual operation of the inching switch 81 can rotationally drive (inching operation) of the inlet rotor 34, the drum 31, and the outlet rotor 35 even when the printing unit 70 is stopped. The inching switch 81 serves as a "inching unit" according to the first embodiment.

An "inching operation" is an operation in which the drum 31 rotates at a lower speed than a rotation speed of the drum 31 during a printing operation only when the inching switch 81 (inching button) is pressed. Further, the "inching operation" is an operation in which a rotation of the drum 31 is stopped when the inching switch 81 (inching button) is released. The user operates a button to perform the inching operation when the user removes the sheet P remaining on the drum 31. Thus, when the user pressed the inching switch 81, the inching switch 81 activates the inching operation.

Further, the inching operation not only rotates the drum 31 in the conveyance direction during the printing operation but also can select one of a forward rotation or a reverse rotation of the drum 31 by a rotation direction selector in inching switch 81. Thus, the inching operation enables a removal process of the sheet P remaining on the circumferential surface of the drum 31, the inlet rotor 34, and the outlet rotor 35, an inspection and replacement of the sheet grippers 311, 341, and 351 during maintenance, a cleaning of the circumferential surface of the drum 31, and a cleaning and replacement of a plate of the drum 31 including the suction holes.

Further, the printer 1 includes a display 811 as described below to notify a state of the printer 1 to the user through the display 811.

Next, a configuration of a second conveyance path 92 according to the first embodiment of the present disclosure is described below.

The printing unit 70 includes a purge tray 91 below the drum 31 in an area between the inlet rotor 34 and the outlet rotor 35. The purge tray 91 is an ejection part to receive the sheet P during a purging operation.

The second conveyance path 92 is directed diagonally downward in a second direction d2 (see FIG. 2) from the receipt position "a" of the inlet rotor 34 on an extension of the loading path 301 toward the purge tray 91. The printing unit 70 includes a conveyance roller pair 93 in the second conveyance path 92. Further, the printing unit 70 includes a purge ejection sensor 94 to detect the sheet P in the purge tray 91. The purge ejection sensor 94 detects that the sheet P to be purged is ejected to the purge tray 91.

Further, the second conveyance path 92 includes a branch pawl 96 as a switching device in a switching part 95. The switching part 95 switches a conveyance path of the sheet P between the first conveyance path 111 and the second conveyance path 92. In other words, the switching part 95 switches a conveyance direction of the sheet P between the first direction d1 and the second direction d2. The switching part 95 is disposed downstream of the receipt position "a" at which the inlet rotor 34 receives the sheet P.

Further, the printing unit 70 includes a purge switch 82 to instruct the inlet rotor 34 and the branch pawl 96 to eject the sheep P to the purge tray 91. Further, the reverse path 61 includes a reverse purge tray 97 (see FIG. 1).

The inching switch 81 and the purge switch 82 may be automatically operated by the printing unit 70 instead of being manually operated by the user.

Figure 3A:
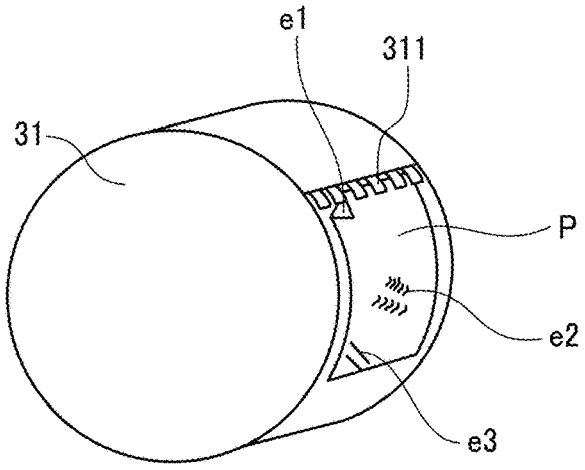
FIGS. 3A and 3B are a schematic perspective view and a cross-sectional front view, respectively, of the drum illustrating a conveyance failure of the sheet.

Next, a configuration of a sheet detector 115 in the first conveyance path is described with reference to FIG. 3. FIGS. 3A and 3B are a schematic perspective view and a cross-sectional front view, respectively, of the drum 31 illustrating a conveyance failure of the sheet P.

The printing unit 70 includes a conveyance failure detector 112 in the first conveyance path 111. The conveyance failure detector 112 detects a displacement of the sheet P on the circumferential surface of the drum 31 in a thickness direction of the sheet P. As illustrated in FIG. 3A, the conveyance failure detector 112 detects conveyance failure such as a folded edge e1, a floating e2, and wrinkles e3 of the sheet P. The "conveyance failure" is not a state in which the conveyance of the sheet P becomes actually difficult. The "conveyance failure" is a state in which the sheet P may cause a conveyance failure. The conveyance failure is one of predetermined conditions to cause the printing unit 70 to stop conveyance of the sheet P and switch the conveyance direction of the sheet P between the first direction d1 and the second direction d2.

If a posture of the sheet P is tilted when the sheet P is suctioned to the drum 31, the leading end of the sheet P comes off from the sheet gripper 311 to cause the folded edge e1, the floating e2, or the wrinkles e3.

Figure 3B:
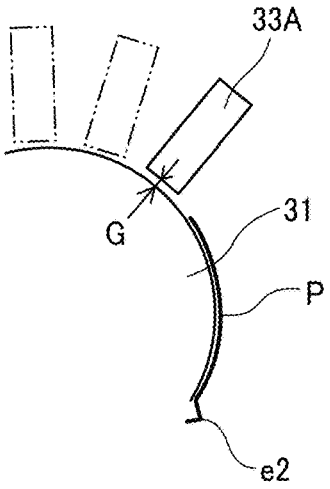

When the sheet P in the above-described state enters a gap G between the circumferential surface of the drum 31 and the discharge unit 33A as illustrated in FIG. 3B, the sheet P may interfere (collide) with the discharge unit 33A and damage a liquid discharge head of the discharge unit 33A.

The printing unit 70 stops driving the drum 31 and the conveyance of the sheet P before the sheet P enters the gap G between the circumferential surface of the drum 31 and the liquid discharge head of the most upstream discharge unit 33A when the conveyance failure detector 112 detects the conveyance failure on the drum 31.

Further, the printing unit 70 includes a first sensor 113 and a second sensor 114 that form the sheet detector 115 to detect the sheet P in the switching part 95.

The first sensor 113 is disposed upstream of the switching part 95. Specifically, the first sensor 113 is disposed upstream of the inlet rotor 34 at a position detectable the sheet P on the loading path 301.

The second sensor 114 is disposed downstream of the switching part 95. Specifically, the second sensor 114 is disposed at a position at which the second sensor 114 is detectable the sheet P on the circumferential surface of the inlet rotor 34.

The sheet P is at the switching part 95 when both the first sensor 113 and the second sensor 114 detect the sheet P.

Figure 4:
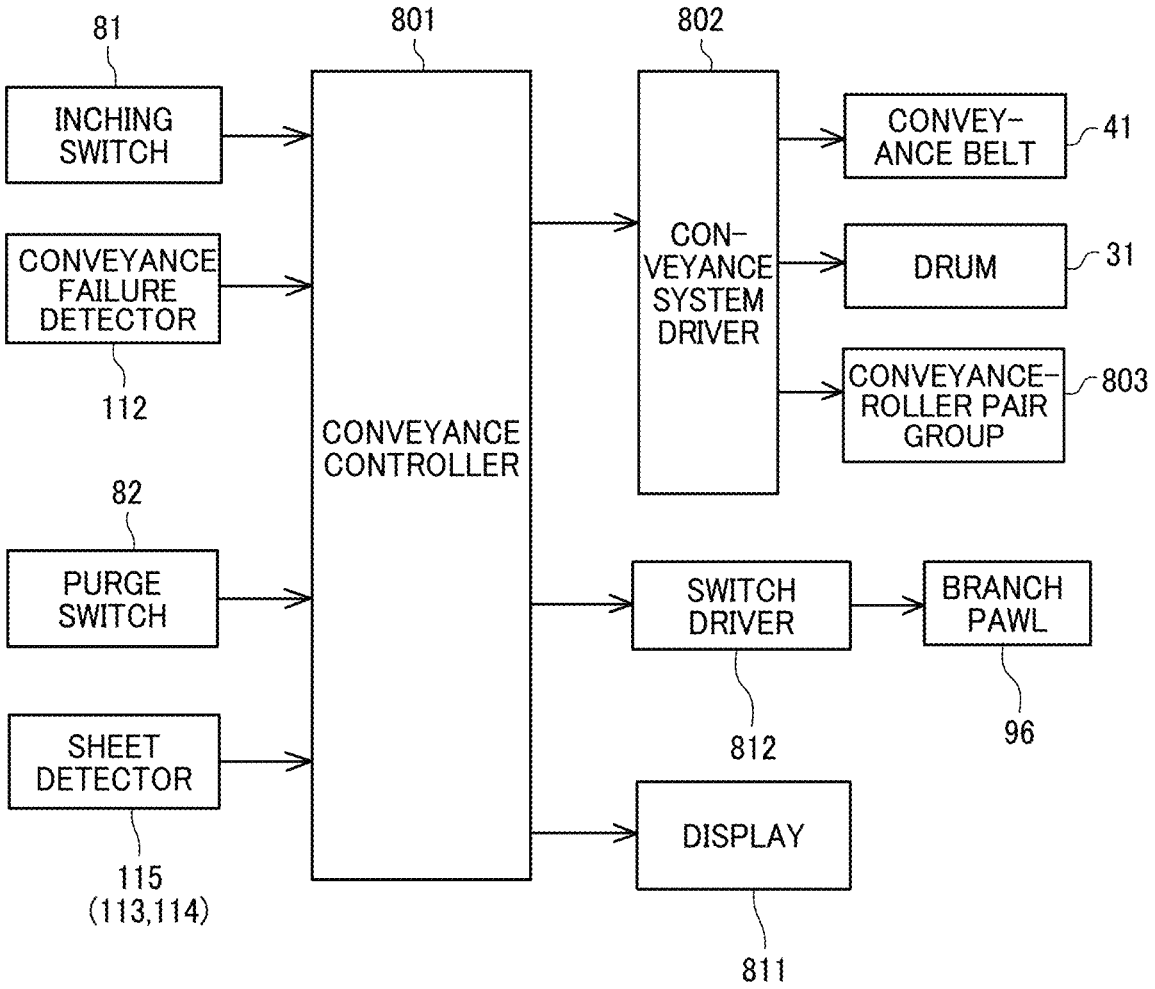
FIG. 4 is a block diagram of a functional configuration of a printing unit illustrating a control of a purge operation of the sheet according to the first embodiment of the present disclosure.

FIG. 4 is a block diagram of a functional configuration of the printing unit 70. FIG. 4 specifically illustrates a part of the printing unit 70 that controls a purge operation of the sheet P according to the first embodiment.

The printing unit 70 includes a conveyance controller 801 (circuitry) to control the conveyance operation such as the purge operation. The conveyance controller 801 control to switch the conveyance path of the sheet P between the first conveyance path 111 and the second conveyance path 92 in the switching part 95. Thus, the conveyance controller 801 control to switch the conveyance direction of the sheet P between the first direction d1 and the second direction d2 in the switching part 95.

When the conveyance failure detector 112 detects a conveyance failure, the conveyance controller 801 stops operations of the drum 31, the conveyance belt 41, and the conveyance-roller pair group 803 such as the conveyance roller pairs 302 and 601 via the conveyance system driver 802 to stop conveyance operation of the sheet P.

When the inching operation is instructed by the inching switch 81, the conveyance controller 801 drives the drum 31, and the inlet rotor 34 and the outlet rotor 35 that move with the drum 31 via the conveyance system driver 802 to control the inching operation.

When the conveyance controller 801 receives an instruction of a purge operation from the purge switch 82, the conveyance controller 801 controls the display 811 to instruct the user to perform the inching operation when the sheet detector 115 (first sensor 113 and second sensor 114) detects the sheet P in the switching part 95.

When the conveyance controller 801 receives the instruction of the purge operation from the purge switch 82, the conveyance controller 801 controls the switch driver 812 drive the branch pawl 96 to change a conveyance path (conveyance direction) of the sheet P from the first conveyance path 111 (first direction d1) to the second conveyance path 92 (second direction d2) and conveys the sheet P after the sheet detector 115 (first sensor 113 and second sensor 114) does not detect the sheet P in the switching part 95.

When the conveyance operation is stopped by a detection of the conveyance failure, the conveyance controller 801 controls the conveyance system driver 802 and the switch driver 812 to perform required operations such as an ejection of a remaining sheet P to the ejector 50, an ejection of the remaining sheet P to the reverse purge tray 97, and an ejection of the remaining sheet P to the purge tray 91.

Figure 5:
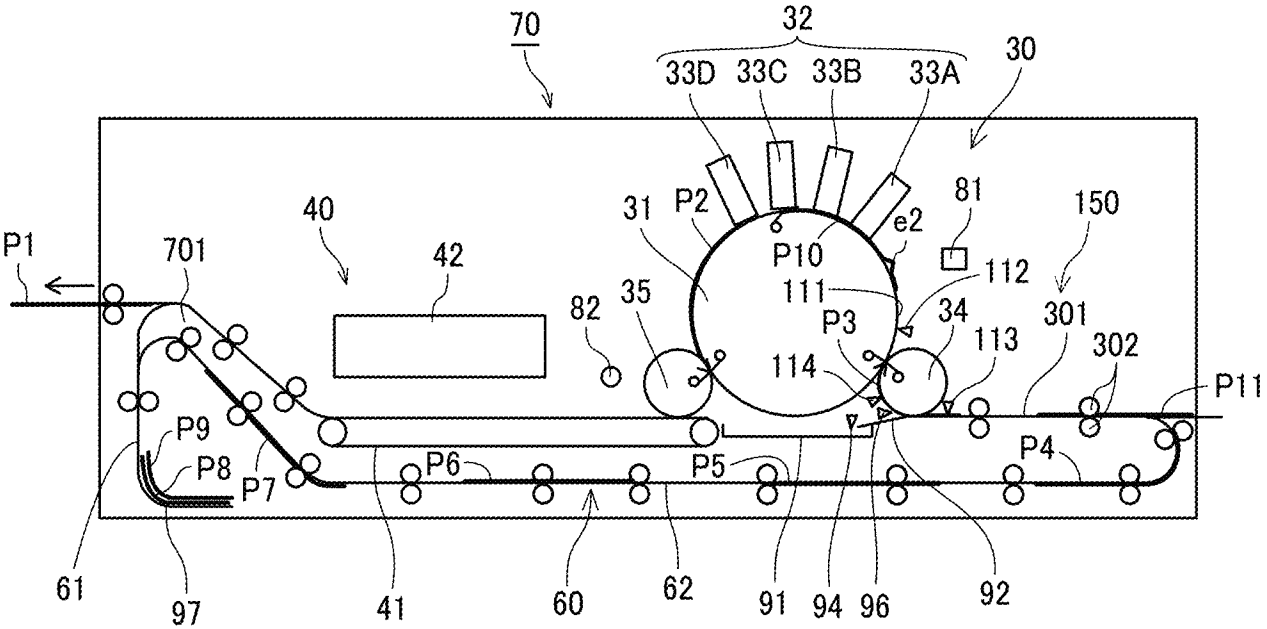
FIG. 5 is a schematic cross-sectional front view of the printing unit illustrating an example of a position of the sheet remaining in the printing unit when the conveyance operation is stopped.

Next, an example of a state of the printing unit 70 in the printer 1 when the conveyance operation is stopped by the conveyance failure is described with reference to FIG. 5. FIG. 5 is a schematic cross-sectional front view of the printing unit 70 illustrating an example of a position of the sheet P remaining in the printing unit 70 when the conveyance operation is stopped.

In FIG. 5, the conveyance failure detector 112 detects a conveyance failure of a floating e2 on a trail end of the sheet P10 on the first conveyance path 111.

When the conveyance failure detector 112 detects an occurrence of a conveyance failure of the sheet P, the conveyance controller 801 immediately stops a rotational driving of the drum 31 and the like to prevent a portion of the floating e2 of the sheet P from entering the gap G between the drum 31 and the discharge unit 33.

However, a certain constant distance is necessary as a brake distance due to an inertial force of the drum 31, the inlet rotor 34, and the outlet rotor 35. Thus, the sheet P that causes the conveyance failure stops at a position slightly advanced from the conveyance failure detector 112. Therefore, a distance between the conveyance failure detector 112 to the head of the discharge unit 33 has to be ensured to be equal to or larger than the above-described brake distance.

On the other hand, the conveyance controller 801 conveys to the ejector 50 the sheet P1, onto which printing of an image has been normally finished, among the sheets P remaining in the dryer 40, the ejection path 701, and the duplex mechanism 60. The conveyance controller 801 conveys the sheet P8 and P9, a back side (second side) of which has not been printed, to the reverse purge tray 97 (second purge tray) below the reverse path 61. The conveyance controller 801 stops a conveyance of the sheet P7, P6, P5, P4, and P11 remaining in a path from the duplex path 62 to the loading path 301.

Further, a nozzle surface of the head of the discharge unit 33 is capped by the cap 38 (see FIG. 2) after the discharge unit 33 moves upward. Thus, the head is not damaged by the sheet P even if the sheet P enters the gap G (see FIG. 3B) between the discharge unit 33 and the drum 31.

After completion of above-described processes, the conveyance controller 801 displays on the display 811 to notify the user about positions of the remaining sheets P and a state of jam.

Figure 6:
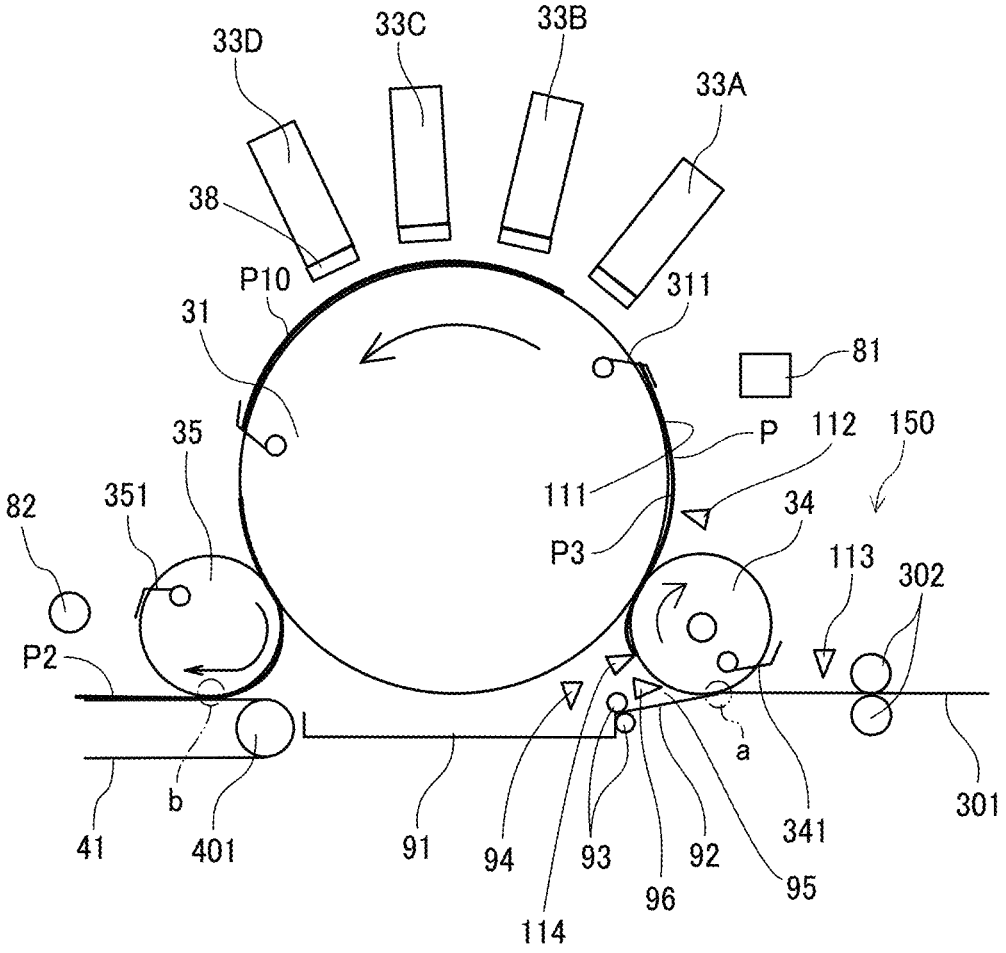
FIG. 6 is an enlarged cross-sectional front view of the printing unit illustrating an inching operation.
Figure 7:
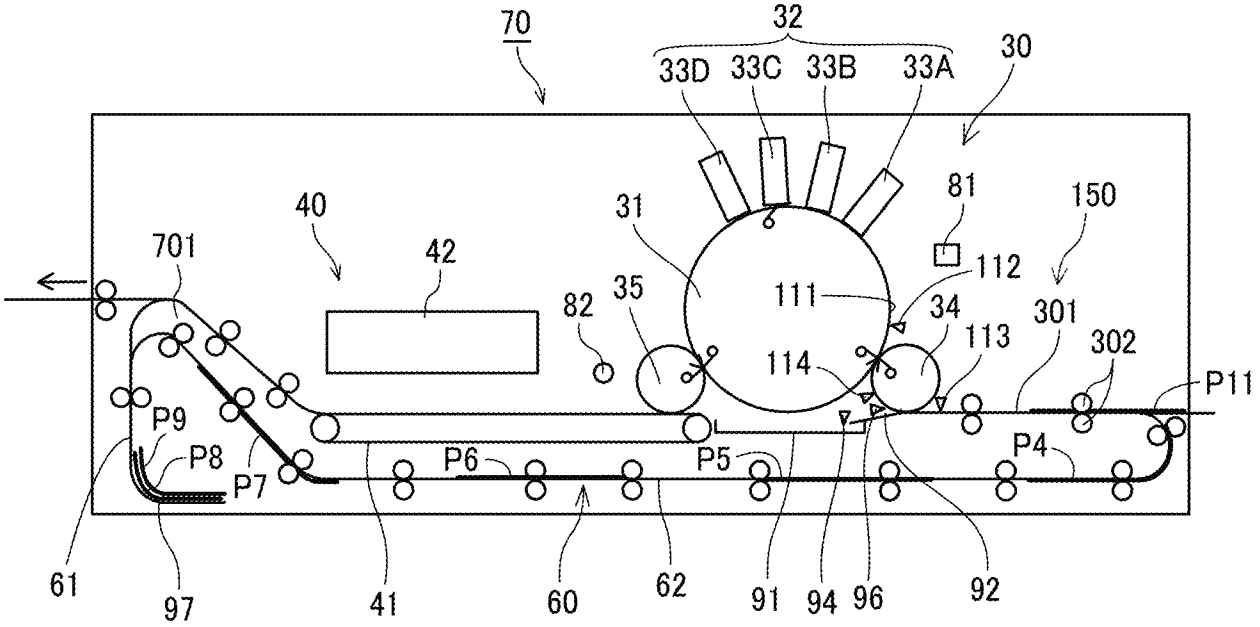
FIG. 7 is a cross-sectional front view of the printing unit illustrating a state of the printing unit after the inching operation.

Next, a removal process of the sheet P remained in the first conveyance path 111 is described with reference to FIGS. 6 and 7. FIG. 6 is a cross-sectional front view of the printing unit 70 illustrating an inching operation. FIG. 7 is a cross-sectional front view of the printing unit 70 illustrating a state of the printing unit 70 after the inching operation.

When the conveyance failure detector 112 detects the conveyance failure, the conveyance controller 801 stops conveyance of the sheet P as described above. Then, the sheet P3 is stopped at a position across the switching part 95 in an example as illustrated in FIG. 5. Thus, when the sheet P11 on the loading path 301 and the sheet P4 to P7 on the duplex path 62 are conveyed to the purge tray 91, the sheet P4 to P7 and P11 may collide with the sheet P3 so that jam occurs.

Therefore, the inching switch 81 as the first operator is used to process the sheet P remaining on the first conveyance path 111. The circumferential surfaces of the inlet rotor 34, the drum 31, and the outlet rotor 35 form the first conveyance path.

A second conveyance path 92 leading to the purge tray 91 is arranged on the extension of the loading path 301 so that the sheet P on the loading path 301 and the duplex path 62 can be conveyed to the purge tray 91 below the drum 31.

When the sheet P is stopped in the state as illustrated in FIG. 5 as described above, the inching switch 81 is operated to cause the inlet rotor 34, the drum 31, and the outlet rotor 35 to rotate in a direction as indicated by arrow in FIG. 6 to perform the inching operation.

Thus, the sheet P2, the sheet P10, and the sheet P3 are sequentially moved to the conveyance belt 41 of the dryer 40 as illustrated in FIG. 7 and removed from the first conveyance path 111. Thus, all the sheets P across the switching part 95 can be removed.

Therefore, an operation of the purge switch 82 switches the branch pawl 96 of the switching part 95 from the first conveyance path 111 (first direction d1) to the second conveyance path 92 (second direction d2). Further, a subsequent purging operation ejects the sheet P11 on the loading path 301 and the sheet P4 to P7 on the duplex path 62 to the purge tray 91.

Figure 8:
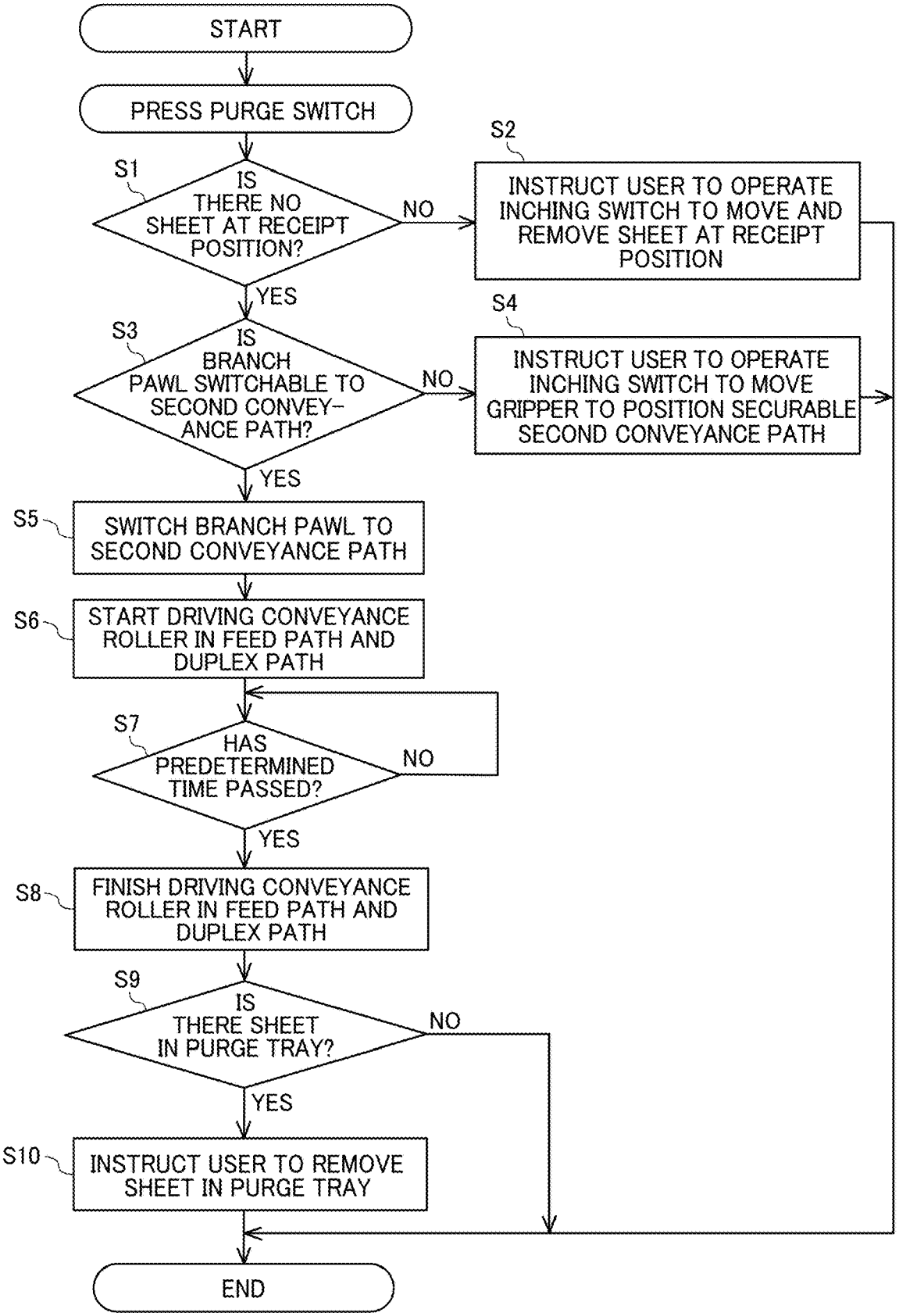
FIG. 8 is a flowchart of a control of a purge operation according to a second embodiment of the present disclosure.
Figure 9:
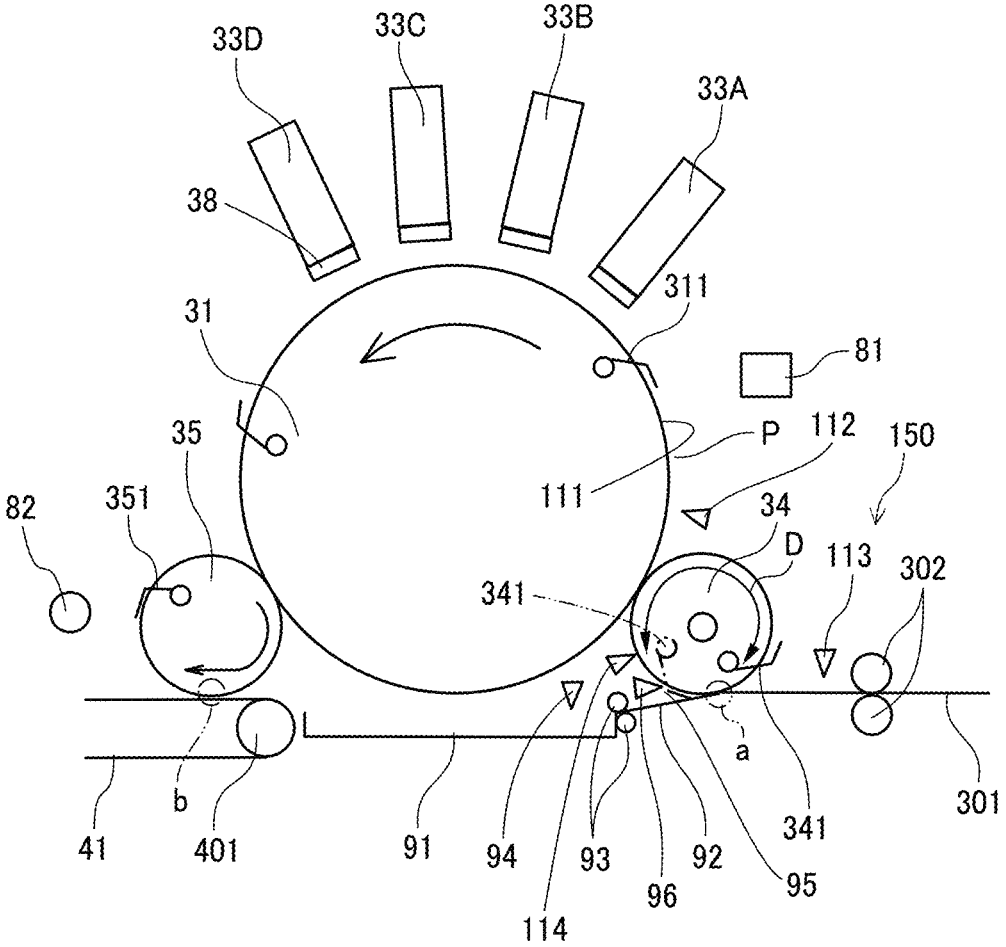
FIG. 9 is an enlarged cross-sectional front view of the printing unit illustrating an example of a state of the printing unit in which the purge switch is pressed.

Next, control of the purge operation is described with reference to FIGS. 8 and 9. FIG. 8 is a flowchart of the control of the purge operation. FIG. 9 is a cross-sectional front view of the printing unit 70 illustrating an example of a state of the printing unit 70 in which the purge switch 82 is pressed.

When the purge switch 82 is pressed, the conveyance controller 801 determines whether there is the sheet P across the switching part 95 (step S1) from each detection result of the sheet detectors 115 (first sensor 113 and second sensor 114). Hereinafter, the step S1 is simply referred to as "S1". Specifically, the conveyance controller 801 determines whether there is the sheet P at the receipt position "a". In FIG. 8, the receipt position "a" is simply referred to as "receipt position." The receipt position "a" is adjacent to the switching part 95.

At the step S1, if there is a sheet P across the receipt position "a" (switching part 95) (S1, NO), the conveyance controller 801 has to remove the sheet P across the receipt position "a" (switching part 95) by operating the inching switch 81. Thus, the conveyance controller 801 controls the display 811 to display and instruct the user to operate inching switch to remove the sheet P at the receipt position "a" (S2).

Conversely, if there is no sheet P across the receipt position "a" (switching part 95) (S1, YES), the conveyance controller 801 determines whether the branch pawl 96 is switchable from the first conveyance path 111 (first direction d1) to the second conveyance path 92 (second direction d2) (S3).

That is, as illustrated in FIG. 9, if the sheet gripper 341 of the inlet rotor 34 is at the receipt position "a" (switching part 95) when the purge switch 82 is pressed, the second conveyance path 92 is blocked by the sheet gripper 341. Therefore, the conveyance controller 801 has to move the sheet gripper 341 to a position at which the sheet gripper 341 of the inlet rotor 34 opens the second conveyance path 92 (does not block the second conveyance path 92).

The conveyance controller 801 detects that the sheet gripper 341 of the inlet rotor 34 is at a retracted position by a reflective sensor. The conveyance controller 801 may detected by detecting a phase of the rotation angle of the inlet rotor 34 and the drum 31 to detect a position of the sheet gripper 341.

When the branch pawl 96 cannot be switched from the first conveyance path 111 (first diction d1) to the second conveyance path 92 (second direction d2), the conveyance controller 801 controls the display 811 to display and instruct the user to operate the inching switch 81 to move the sheet gripper 341 to the retracted position (S4).

Conversely, when the branch pawl 96 is switchable from the first conveyance path 111 (first direction d1) to the second conveyance path 92 (second direction d2), the conveyance controller 801 switches the branch pawl 96 from the first conveyance path 111 (first direction d1) to the second conveyance path 92 (second direction d2) (S5).

Then, the conveyance controller 801 starts driving the conveyance roller pair 302 of the loading path 301 and the conveyance roller pair 601 of the duplex path 62 and the like (S6). Thus, the sheets P11, P4, P5, P6, and P7 are conveyed to the purge tray 91 and collected at the purge tray 91.

Then, the conveyance controller 801 determines whether a predetermined time has elapsed (S7). The conveyance controller 801 finishes driving and stops the conveyance roller pair 302 of the loading path 301 and the conveyance roller pair 601 of the duplex path 62 and the like (S8) when the predetermined time has elapsed (S7, YES).

Then, the conveyance controller 801 determines whether there is a sheet P housed in the purge tray 91 (S9). If there is a sheet P housed in the purge tray 91 (S9, YES), the conveyance controller 801 instructs the user to remove the sheet P in the purge tray 91 (S10).

The conveyance controller 801 thus controls the branch pawl 96 to switch from the first conveyance path 111 (first direction d1) to the second conveyance path 92 (second direction d2) after the sheet detector 115 detects no sheet P in the switching part 95. Thus, the printer 1 can prevent an occurrence of jam during processing the remaining sheet P to prevent a decrease in productivity of the printing operation.

Figure 10:
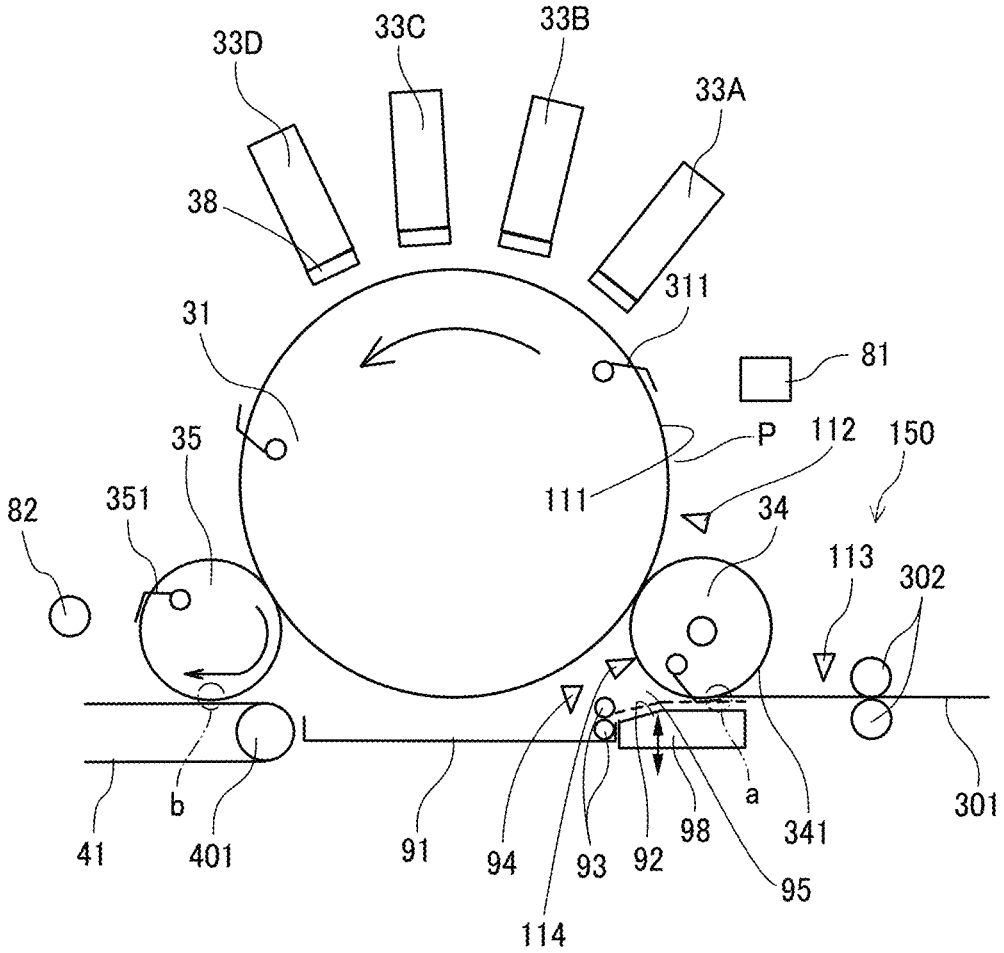
FIG. 10 is an enlarged cross-sectional front view of the printing unit according to the second embodiment of the present disclosure illustrating a state in which the purge switch is pressed.

Next, the printer 1 according to a second embodiment of the present disclosure is described with reference to FIG. 10. FIG. 10 is a schematic front view of the printing unit 70 according to the second embodiment illustrating a state in which the purge switch 82 is pressed.

The printing unit 70 in the second embodiment includes the second conveyance path 92 that includes a vertical moving part 98. The vertical moving part 98 is advanceably retractable between a first position indicated by broken line and a second position indicated by solid line with respect to the inlet rotor 34. Thus, the vertical moving part 98 is also referred to as an "advanceably retractable part".

The vertical moving part 98 can move between the first position and the second position. In the first position, a gap between the circumferential surface of the inlet rotor 34 and the vertical moving part 98 is about 1 mm. In the second position, the gap between the circumferential surface of the inlet rotor 34 and the vertical moving part 98 is about 3 to 10 mm. Further, the sheet P is guided to the first conveyance path 111 when the vertical moving part 98 is at the first position, and the sheet P is guided to the second conveyance path 92 when the vertical moving part 98 is at the second position.

Then, when the purge switch 82 is pressed, the vertical moving part 98 moves downward to the second position away from the circumferential surface of the inlet rotor 34 as illustrated in FIG. 10. Thus, the sheet P hangs down on the second conveyance path 92 by own weight and is guided to the second conveyance path 92.

Thus, the second conveyance path 92 is lowered to a position not affected by the sheet gripper 341 of the inlet rotor 34. Even if the sheet gripper 341 is at the receipt position "a", the sheet P can move along the second conveyance path 92 by own weight.

Thus, the printing unit 70 in the second embodiment includes the vertical moving part 98 configures a switching part to switch between the first conveyance path 111 (first direction d1) and the second conveyance path 92 (second direction d2).

Therefore, instead of step S5, in which the branch pawl 96 is switched from the first conveyance path 111 (first direction d1) to the second conveyance path 92 (second direction d2), as illustrated in the flowchart of FIG. 8 in the first embodiment, the conveyance controller 801 according to the second embodiment moves the vertical moving part 98 downward to the second position when the purge switch 82 is pressed. Thus, the printing unit 70 according to the second embodiment is not necessary to move the sheet gripper 341 to the retracted position.

Thus, the vertical moving part 98 can further reduce downtime during the printing operation.

Figure 11:
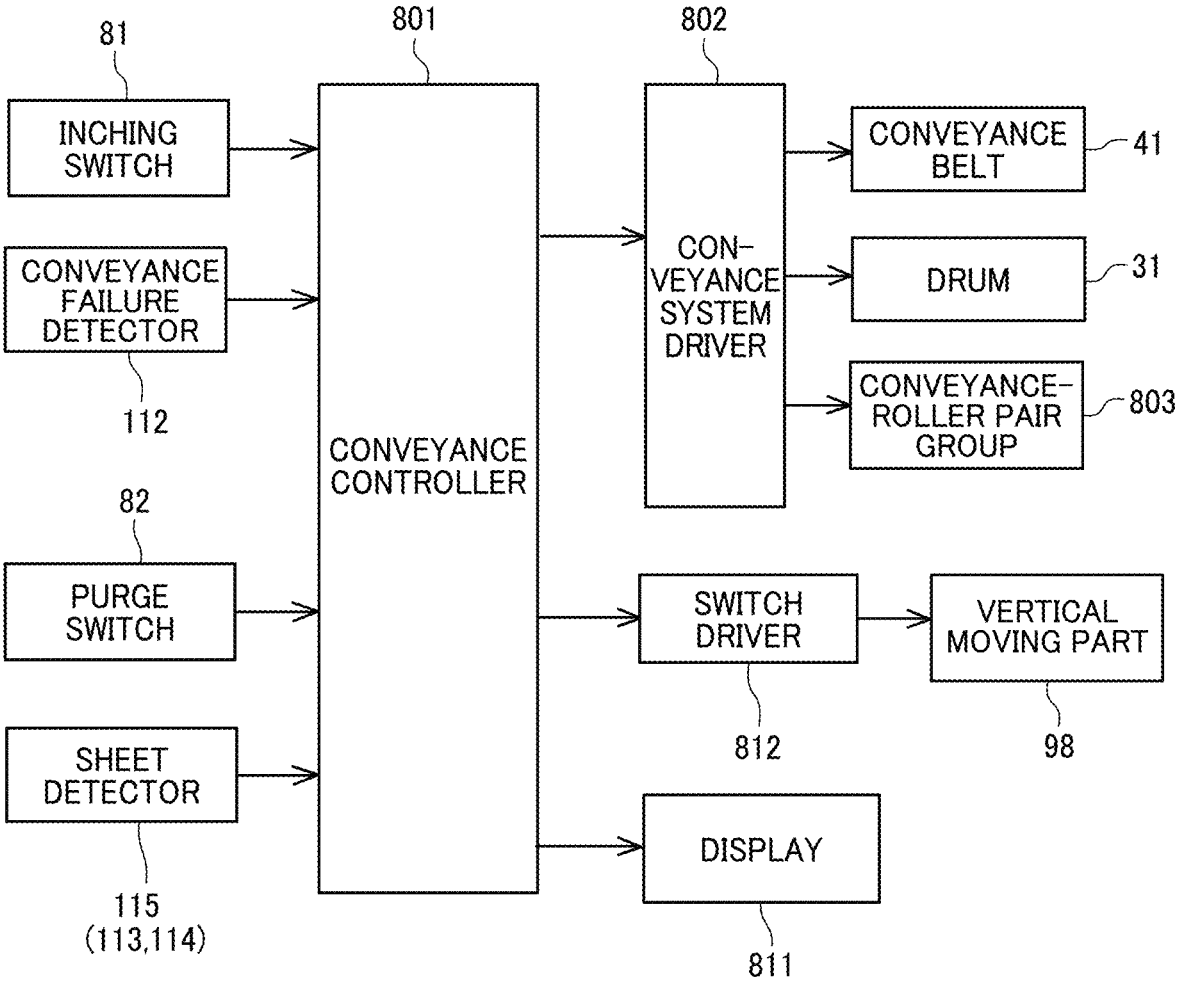
FIG. 11 is a block diagram of a functional configuration of a printing unit illustrating a control of a purge operation of the sheet according to the second embodiment of the present disclosure.

FIG. 11 is a block diagram of a functional configuration of the printing unit 70. FIG. 11 specifically illustrates a part of the printing unit 70 that controls a purge operation of the sheet P according to the second embodiment.

The conveyance controller 801 controls the vertical moving part 98 to advanceably retract the vertical moving member in a vertical direction between the first conveyance path 111 and the second conveyance path 92 via the switch driver 812 Other configurations of the printing unit 70 according to the second embodiment as illustrated in FIG. 11 are identical to the configurations of the printing unit 70 in the first embodiment as illustrated in FIG. 8.

Figure 12:
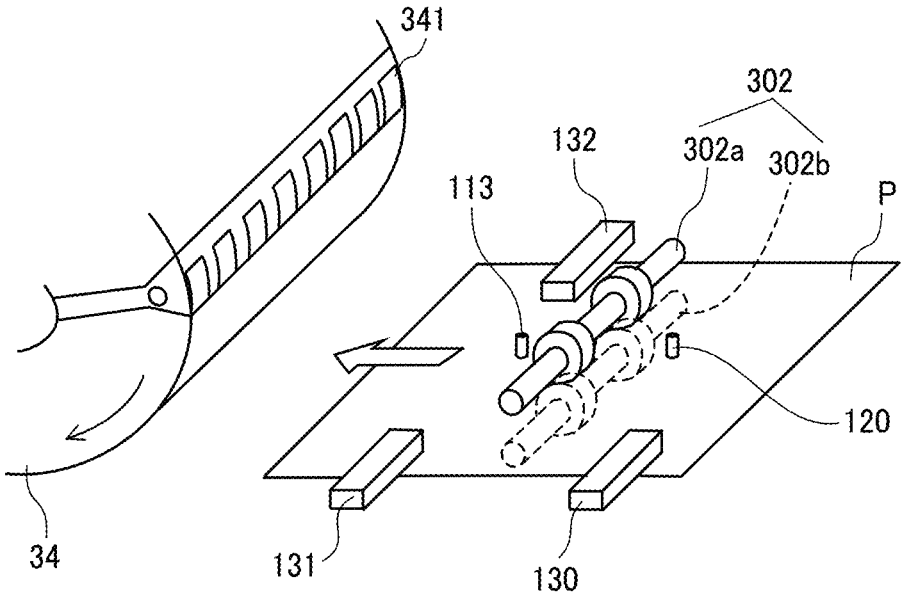
FIG. 12 is an enlarged partial perspective view of the printing unit illustrating a detection method of a sheet length, a sheet width, and a skew.

Next, an example of a detection method of a sheet length, a sheet width, and a skew is described with reference to FIG. 12. FIG. 12 is an enlarged partial perspective view of the printing unit 70 illustrating the detection method.

The printing unit 70 includes the sensor 120 on an upstream of the conveyance roller pair 302 and the first sensor 113 downstream of the conveyance roller pair 302 in the loading path 301 in a conveyance direction of the sheet P as indicated by arrow in FIG. 12. Thus, the conveyance roller pair 302 is sandwiched between the first sensor 113 and the sensor 120.

Further, the printing unit 70 includes sensors 130, 131, and 132. Each of the sensors 130, 131, and 132 includes a line sensor detectable an edge of the sheet P in a width direction of the sheet P. The sensor 130 is arranged on an upstream of the conveyance roller pair 302 in the conveyance direction of the sheet P, and the sensor 131 is arranged on a downstream of the conveyance roller pair 302 in the conveyance direction of the sheet P.

The sensors 130 and 131 are arranged on one end (front end in FIG. 12) in the width direction of the sheet P. Conversely, the sensor 132 is arranged on another end (rear end in FIG. 12) opposite to the one end at which the sensor 131 is arranged in the width direction of the sheet P.

Further, the conveyance roller pair 302 includes a driven roller 302*a* and a driving roller 302*b*. The driven roller 302*a* includes a rotary encoder and a sensor to measure an amount of rotation (rotational distance) of the driven roller 302*a*.

The conveyance controller 801 starts measuring the amount of rotation (rotation distance) of the driven roller 302*a* when the leading end of the sheet P conveyed along the loading path 301 turns on the first sensor 113 to detect the sheet length (length of the sheet P).

Then, the conveyance controller 801 finishes a measurement of the amount of rotation (rotation distance) of the driven roller 302*a* when the rear end of the sheet P turns off the sensor 120. Then, the conveyance controller 801 adds a measured value of the sheet length and a physical distance between the first sensor 113 and the sensor 120 to calculate the sheet length of the sheet P.

The conveyance controller 801 may change a detection method of the sheet length according to an accuracy of the detection method. For example, the conveyance controller 801 may simply multiply a time from turning on to turning off of the first sensor 113 by the sheet P and a conveyance speed of the sheet P to calculate the sheet length. Thus, the above-described configurations of the conveyance controller 801, the driven roller 302*a*, the first sensor 113, and the sensors 120 and 130 to 132 form a sheet length detector.

Further, the conveyance controller 801 controls each of the sensors 130, 131 and 132 to read an edge of the sheet P in the width direction of the sheet P after predetermined time has been passed since the leading end of the sheet P conveyed along the loading path 301 turns on the first sensor 113 as a trigger to detect the sheet width (width of the sheet material P) and skew of the sheet P.

The conveyance controller 801 detects a physical distance of the sheet P from reading values of the sensors 131 and 132 to determine the sheet width of the sheet P. Further, the conveyance controller 801 calculates a skew amount of the sheet P from a difference between the reading values of the sensors 130 and 131. Thus, the conveyance controller 801, and the sensors 131 and 132 forms a sheet width detector. Further, the conveyance controller 801, and the sensors 130 and 131 forms a sheet skew detector.

Figure 13:
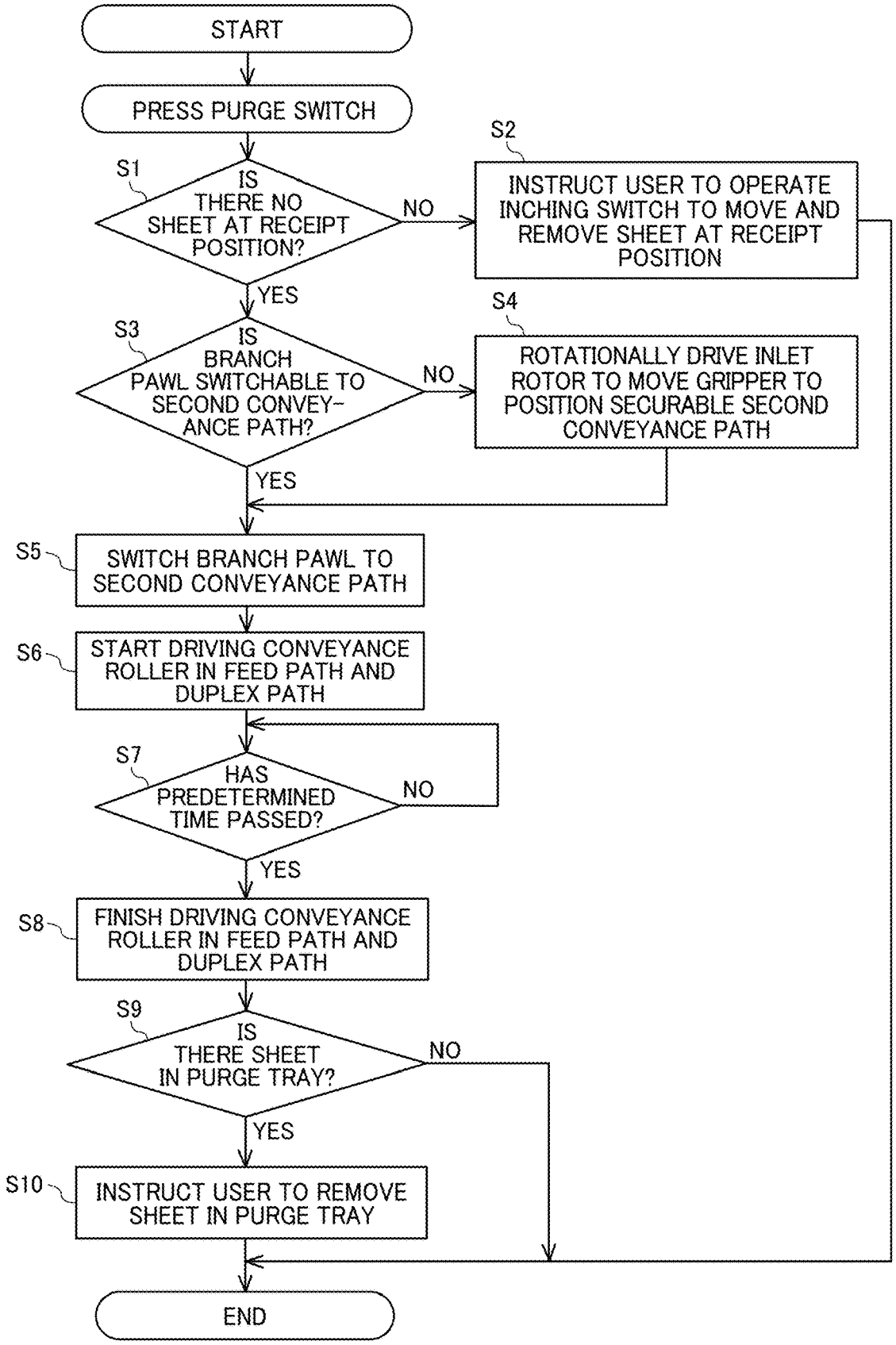
FIG. 13 is a flowchart of a control of a purge operation according to a third embodiment of the present disclosure.

Next, control of the purge operation according to a third embodiment of the present disclosure is described with reference to FIG. 13. FIG. 13 is a flowchart of a control of a purge operation according to the third embodiment of the present disclosure. A control flow of the purge operation of the third embodiment differs only in a portion of step S4 as compared with the control flow of the purge operation according to the first embodiment as illustrated in FIG. 8.

The conveyance controller 801 according to the third embodiment rotationally drives the drum 31 to rotate the inlet rotor 34 geared with the drum 31 when the branch pawl 96 cannot be switched from the first conveyance path 111 (first direction d1) to the second conveyance path 92 (second direction d2) in step S3 (S3, NO) to move the sheet gripper 341 to a position that does not interfere with a switching operation of the branch pawl 96 (S4).

Then, the conveyance controller 801 switches the branch pawl 96 from the first conveyance path 111 (first direction d2) to the second conveyance path 92 (second direction d2) (S5). Thus, the conveyance controller 801 can automatically switches the branch pawl 96 from the first conveyance path 111 (first direction d1) to the second conveyance path 92 (second direction d2) regardless of the position of the sheet gripper 341 of the inlet rotor 34.

The printing unit 70 may detect the position of the sheet gripper 341 by a reflective sensor in step S4 in the third embodiment of the present disclosure. Further, the printing unit 70 may detect a phase of a rotation angle of the inlet rotor 34 and the drum 31 using an encoder to detect the position of the sheet gripper 341.

Each of the functions of the described embodiments such as the conveyance controller 801 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A conveyor comprising:

a first conveyance path along which a sheet is conveyed in a first direction;

a second conveyance path along which the sheet is conveyed in a second direction different from the first direction;

a switching part configured to switch a conveyance direction of the sheet between the first direction and the second direction;

a sheet detector configured to detect the sheet at the switching part;

a conveyance system driver configured to convey and stop the sheet;

circuitry configured to:

control the conveyance system driver to stop conveyance of the sheet in a predetermined condition, control the sheet detector to detect the sheet at the switching part, and control the switching part to switch the conveyance direction of the sheet from the first direction to the second direction when the sheet detector does not detect the sheet at the switching part; and an inching switch configured to activate an inching operation, wherein, when the inching switch is pressed, the circuitry controls the conveyance system driver to convey the sheet on the first conveyance path by an inching operation in which a drum on the first conveyance path rotates at a lower speed than a rotation speed of the drum during a printing operation when the inching switch is pressed.

2. The conveyor according to claim 1, wherein the first conveyance path comprises:

the drum, the drum being configured to bear the sheet and rotate;

an inlet rotor configured to transfer the sheet to the drum; and an outlet rotor configured to receive the sheet from the drum.

3. The conveyor according to claim 2, further comprising:

a conveyance failure detector, located downstream of the inlet rotor in the conveyance direction of the sheet, configured to detect a conveyance failure on the first conveyance path, wherein, in the predetermined condition, the conveyance failure detector detects the conveyance failure.

4. The conveyor according to claim 2, wherein the inlet rotor includes a gripper configured to grip the sheet, and the gripper of the inlet rotor is retractable from the switching part when the switching part switches the conveyance direction of the sheet from the first direction to the second direction.

5. The conveyor according to claim 3, further comprising:

a display configured to display an instruction received from the circuitry, wherein, when the conveyance failure detector detects the conveyance failure, the circuitry controls the conveyance system driver to stop conveyance of the sheet on the first conveyance path; and controls the display to display the instruction of a removal of the sheet on the first conveyance path.

6. The conveyor according to claim 1, wherein, when the inching switch is pressed, the circuitry controls the conveyance system driver to:

convey at least one of:

the sheet across the switching part; and the sheet on the first conveyance path.

7. The conveyor according to claim 1, further comprising:

a conveyance path upstream of the switching part; and a duplex path in which a front surface and a back surface of the sheet is reversed, wherein the circuitry is further configured to control the conveyance system driver to:

convey, to the second conveyance path, the sheet on the conveyance path upstream of the switching part and the sheet on the duplex path in which a front surface and a back surface of the sheet has been reversed.

8. The conveyor according to claim 7, further comprising:

a branch pawl configured to switch the conveyance direction of the sheet between the first direction and the second direction;

a display configured to display an instruction received from the circuitry, wherein the circuitry is further configured to:

control the display to display the instruction to perform a purge operation;

control the branch pawl to switch the conveyance direction of the sheet from the first conveyance path to the second conveyance path to perform the purge operation; and control the conveyance system driver to eject the sheet to a purge tray via the second conveyance path.

9. The conveyor according to claim 1, further comprising:

a branch pawl configured to switch the conveyance direction of the sheet between the first direction and the second direction.

10. The conveyor according to claim 1, wherein the switching part comprises:

a vertical moving part configured to advanceably retract the second conveyance path from the first conveyance path, and the sheet is guided to the second conveyance path retracted from the first conveyance path.

11. The conveyor according to claim 1, further comprising:

a skew detector configured to detect a skew of the sheet.

12. The conveyor according to claim 1, further comprising:

a sheet width detector configured to detect a width of the sheet.

13. The conveyor according to claim 1, further comprising:

a sheet length detector configured to detect a length of the sheet.

14. A printer comprising:

an image forming unit configured to print an image on the sheet; and the conveyor according to claim 1.

15. A conveyor comprising:

a first conveyance path along which a sheet is conveyed in a first direction;

a second conveyance path along which the sheet is conveyed in a second direction different from the first direction;

a switching part configured to switch a conveyance direction of the sheet between the first direction and the second direction;

a sheet detector configured to detect the sheet at the switching part;

a conveyance system driver configured to convey and stop the sheet;

a conveyance failure detector configured to detect a conveyance failure;

circuitry configured to:

control the conveyance system driver to stop conveyance of the sheet when the conveyance failure detector detects the conveyance failure, control the sheet detector to detect the sheet at the switching part, and control the switching part to switch the conveyance direction of the sheet from the first direction to the second direction when the sheet detector does not detect the sheet at the switching part; and an inching switch configured to activate an inching operation, wherein, when the inching switch is pressed, the circuitry controls the conveyance system driver to convey the sheet on the first conveyance path by an inching operation in which a drum on the first conveyance path rotates at a lower speed than a rotation speed of the drum during a printing operation when the inching switch is pressed.

16. A printer comprising:

an image forming unit configured to print an image on the sheet; and the conveyor according to claim 15.

17. A conveyor comprising:

a first conveyance path along which a sheet is conveyed in a first direction;

a second conveyance path along which the sheet is conveyed in a second direction different from the first direction;

a switching part configured to switch a conveyance direction of the sheet between the first direction and the second direction;

a conveyance path upstream of the switching part;

a duplex path in which a front surface and a back surface of the sheet is reversed;

a sheet detector configured to detect the sheet at the switching part;

a conveyance system driver configured to convey and stop the sheet; and circuitry configured to:

control the conveyance system driver to stop conveyance of the sheet in a predetermined condition, control the sheet detector to detect the sheet at the switching part, and control the switching part to switch the conveyance direction of the sheet from the first direction to the second direction when the sheet detector does not detect the sheet at the switching part, wherein the circuitry is further configured to control the conveyance system driver to convey, to the second conveyance path, the sheet on the conveyance path upstream of the switching part and the sheet on the duplex path in which a front surface and a back surface of the sheet has been reversed.

18. A printer comprising:

an image forming unit configured to print an image on the sheet; and the conveyor according to claim 17.

* * * * *